United States Patent [19]

Gustafsson

[11] 4,348,865

[45] Sep. 14, 1982

[54] HELICAL GEAR MACHINE WITH REGULATED OUTLET

[75] Inventor: Berth U. Gustafsson, Österskär, Sweden

[73] Assignee: AB Bonnierföretagen, Sweden

[21] Appl. No.: 194,296

[22] PCT Filed: Sep. 6, 1979

[86] PCT No.: PCT/SE79/00181

§ 371 Date: May 2, 1980

§ 102(e) Date: May 2, 1980

[87] PCT Pub. No.: WO80/00591

PCT Pub. Date: Apr. 3, 1980

[30] Foreign Application Priority Data

Sep. 6, 1978 [SE] Sweden ..... 7809392

[51] Int. Cl.[3] ..... F16D 31/04; F04B 49/02; F01C 1/16; F04C 18/16

[52] U.S. Cl. ..... 60/493; 60/494; 417/440; 418/201

[58] Field of Search ..... 418/159, 197, 201, 203, 418/202; 60/468, 489, 493, 494; 417/440; 137/625, 48

[56] References Cited

U.S. PATENT DOCUMENTS

| | | | |
|---|---|---|---|
| 2,016,040 | 10/1935 | Kennedy | 60/468 |
| 2,266,820 | 12/1941 | Smith | 418/201 |
| 2,515,301 | 7/1950 | Hughey | 137/625.48 |
| 2,623,469 | 12/1952 | Gray | 418/201 |
| 2,656,972 | 10/1953 | Rathman | 418/201 |
| 3,451,614 | 6/1969 | Tosh | 417/440 |
| 3,527,548 | 9/1970 | Kocher et al. | 418/201 |
| 3,773,444 | 11/1973 | Koch | 418/201 |
| 4,042,310 | 8/1977 | Schibbye et al. | 418/201 |

FOREIGN PATENT DOCUMENTS

| | | | |
|---|---|---|---|
| 44608 | 9/1931 | Denmark | 418/202 |
| 585461 | 10/1933 | Fed. Rep. of Germany | 60/489 |
| 1180214 | 12/1958 | France | 60/493 |
| 529731 | 7/1955 | Italy | 60/489 |
| 1300867 | 12/1972 | United Kingdom | 418/201 |
| 269393 | 1/1972 | U.S.S.R. | 418/201 |

*Primary Examiner*—John J. Vrablik

*Attorney, Agent, or Firm*—Burns, Doane, Swecker & Mathis

[57] ABSTRACT

A gear machine comprises two helical gears (1, 2) in mutual mesh for compressing or pumping a fluid. The suction side of the machine can be made conventionally. The outlet port (4) of the machine is made as a plurality of holes (14), extending in towards the meshing zone at one side of the gear pair. The plurality of holes opens at one end (14*a*) within a Y-shaped area comprising the union of the surfaces which are each defined by the respective gear top and bottom circles (K, L) between a plane (P) through the axes of the gears and a gear radius (R) forming an angle to the axis plane at most attaining $B \times (1/R) \times \text{tangent } \beta$, where B is the width of the gear pair, R is the outside circle radius of the respective gear, and $\beta$ is the helix angle of the gears. At their other ends (14*b*), said holes are connected to a duct (6) at axially separated places in the duct, in the same order as they in the peripheral direction of the gears, open out onto said end surface. A sealing piston (7) is displaceably arranged in the duct, and one end (0) of the duct communicates with the fluid outlet of the machine so that the machine can be controlled at a constant rate of revolutions by displacing the piston in the duct.

7 Claims, 13 Drawing Figures

HELICAL GEAR MACHINE WITH REGULATED OUTLET

TECHNICAL FIELD

The present invention relates to a gear machine comprising at least two helical gears or screw gears running in mesh with each other, a first sealing body coming against one end surface of the gear pair, and a fluid port in the first sealing body.

BACKGROUND ART

Gear machines for use as hydraulic pumps have been well-known for a long time. A permanent disadvantage with known such machines, is however, that it has so far not been possible to regulate their capacity without loosing driving energy.

OBJECT OF THE INVENTION

One object of the invention is therefore to provide a gear machine of the type mentioned in the introduction with a controllable capacity. A further object is to provide a machine of the type mentioned in the introduction, which can be utilized as a gear compressor with simply variable supercharging.

SUMMARY OF THE INVENTION

In a gear machine of the type mentioned in the introduction these objects are in accordance with the invention achieved in that a second sealing body comes against the outside circles of the gears at one gear nip, that the tooth tops of the gears are arranged to seal against the tooth bottoms in the axis plane of the gears, that the port includes a plurality of holes which at one end open out to said end surface of the gear pair in a zone comprising an area substantially including the union of the surfaces, each defined by the top and bottom circles of the respective gear between the axis plane and a gear radius forming an angle to the axis plane attaining at most $(B \tan \beta)/R$, where B is the width of the gear pair, R is the outside circle radius of the respective gear, and $\beta$ is the helix angle of the gears, that the other ends of the holes open out in a duct at axially spaced places in the duct in the same order as they open out, in the circumferential direction of the gears, to said end surface in that a sealing piston is displaceably arranged in the duct, and that one end of the duct communicates with the fluid outlet of the machine, whereby the machine can be controlled at constant revolutions by displacing the piston in the duct.

For the case where the machine is to be utilized as a gear compressor, the piston is suitably adapted to close the holes in a direction inwards towards the axis plane, whereby the axial length of the piston in the duct determines the supercharging of the machine.

The helical teeth of the inventive machine are also to be regarded as including screws such as those utilized in conventional screw pumps or screw compressors, since the inventive concept is applicable to such apparatus also.

Screw pumps have previously been modified into supercharging screw compressors (so-called Lysholm compressors) e.g. by reducing the pitch of the screws in a direction towards the outlet. This results in high screw manufacturing costs. Conventional screw pumps can now be modified into supercharging pumps with the aid of the invention, by arranging an end wall at the outlet end of the screws, provided with a port arrangement in accordance with the present invention. The inventive idea is thus also applicable to screw machines, the "teeth" of which extend more than one revolution round the "gear wheels".

For practical reasons, the angle between the axis plane and the radius should be less than 90° and preferably about 60°, and the expression $B \times (1/R) \times \tan \beta$ should be supplemented by the factor $n \times 2\pi$ for the case where the inventive idea is to be utilized in screw machines proper (n being a positive whole number corresponding to the number of complete revolutions a "tooth" extends round the screw).

It is however possible to connect each of the upper branches of the Y-shaped port to a duct (possibly a straight duct) which is directed as far as possible along the respective branch portion. Two such ducts, each with its control piston, can then substantially replace the upper part of the previously mentioned duct.

In the case where the inventive machine is to be utilized as a hydraulic pump, the other end of the duct is arranged for communication with the fluid inlet of the machine, the piston having a relatively short axial extension, whereby the position of the piston in the duct controls the machine capacity by functioning as a flow distributor.

The inventive hydraulic pump is well disposed for being utilized as the driving unit in a gearbox, the driven part of which constitutes a conventional hydraulic motor. By thus connecting together the hydraulic pump in accordance with the invention and a conventional hydraulic motor, a gearbox is achieved the output shaft of which, i.e. the output shaft of the hydraulic motor, can be given a revolutionary speed independent of that of the gear pump. It is thus possible to conceive that the hydraulic pump is driven at a constant speed and the revolutions per minute of the hydraulic motor are varied from 0 up to a predetermined rate of revolutions which can be relatively high, the change in revolution rate being provided by displacing the piston in the duct.

One can arrange ducts especially so that the departing flow from the hydraulic motor can be directly refluxed to the suction side of the hydraulic pump.

A reversible hydraulic motor can be used as hydraulic motor, and a valve means can be provided which allows selectable connection of said one end of the control duct to either of the hydraulic motor inlets, the valve means being suitably arranged for simultaneously connecting the temporary outlet of the hydraulic motor to the suction side of the hydraulic pump.

The invention is defined in the accompanying patent claims.

BRIEF DESCRIPTION OF DRAWINGS

The invention will now be described in detail and in the form of an example while referring to the attached drawing.

DETAILED DESCRIPTION OF THE PREFERRED EMBODIMENTS

Figure 1:
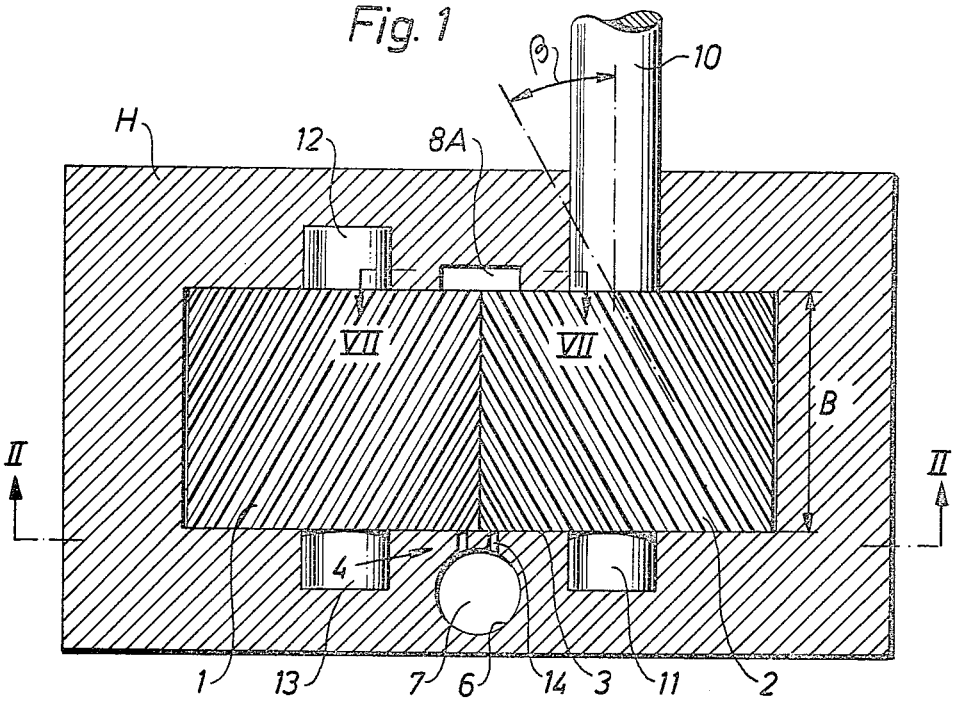
FIG. 1 is a schematic section through a first embodiment of the invention.

Two gears 1 and 2 are illustrated in FIG. 1, and are adapted for running in mesh with each other. The gears 1, 2 are arranged in a housing H surrounding the gears 1, 2 and carrying bearings for the gear shaft ends 10–13, of which the shaft end 10 constitutes the driving shaft of the machine.

Figure 2:
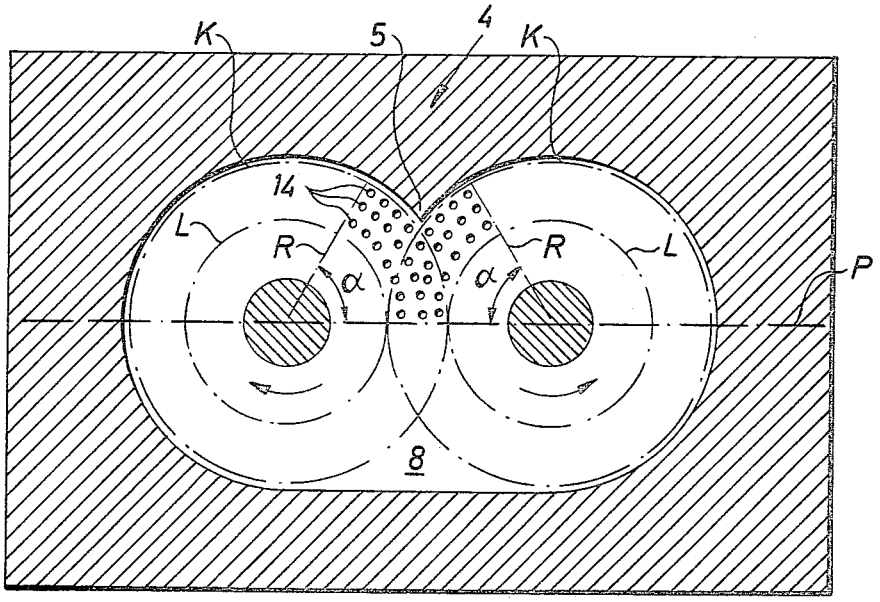
FIG. 2 is a section taken along the line II—II in FIG. 1.

The gears 1, 2 are arranged for rotation in the directions illustrated by arrows in FIG. 2. At the meshing zone, the housing H includes a sealing body 5, extending down into the meshing zone and following the outside circles K of the gears. The gear teeth are suitably made as evolvent teeth, although the bottom and upper lands have a profile following a continuous curve, preferably a circular arc, so that the top lands of one wheel roll sealingly against the bottom lands of the other, and vice versa, in the plane P through the axes of the gears 1, 2. The gears can be assumed to have a width B and a helix angle $\beta$ so that a top land in the plane P at one end of the gear pair lies along the line R in FIG. 2 at the other end of the gear pair. The line R constitutes a gear radius. The angle $\alpha$ between the radius R and the plane P suitably attains the value of the tangent of the helix angle times the gear width/gear radius. The area bounded by the plane P, radii R, the outside circles K and root circle L of the gears defining a port area for the machine when it is driven as a pump.

The outlet port 4 consists of a plurality of holes 14 opening out at the end surface of the gear in the meshing zone thereof, within the outlet port area defined above. At their other ends **14*b*, the holes 14 open out into a duct 6. The holes 14 are preferably arranged such that in the axial direction of the duct 6 they open out in the same order as they open out into the outlet port area 4** in the rotational direction of the gears.

Figure 3:
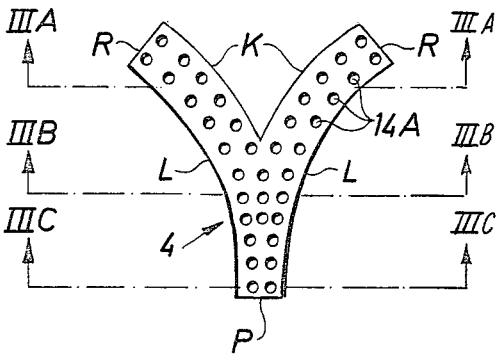
FIGS. 3 and 3' are schematic views of the fluid port in the apparatus in accordance with the invention, and how the holes in the port open out at the port end surface of the gear pair and the control duct, respectively.
Figure 3:
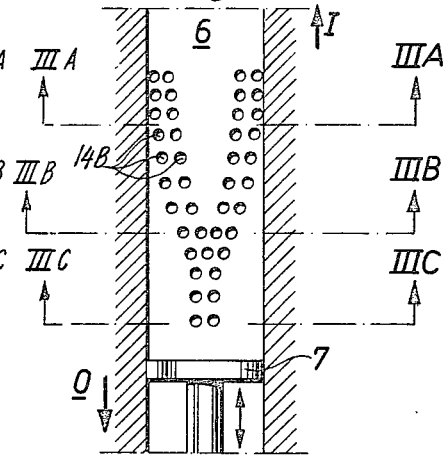
Figure 3A:
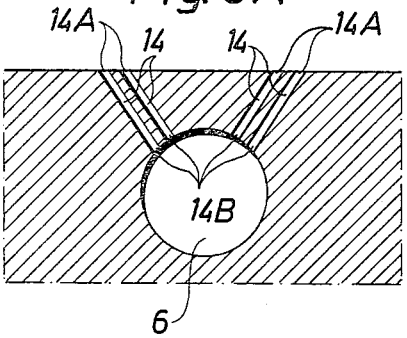
FIGS. 3*a*–3*c* are sections taken along the lines III*a*—III*a*, III*b*—III*b* and III*c*—III*c* in FIGS. 3 and 3'.
Figure 3B:
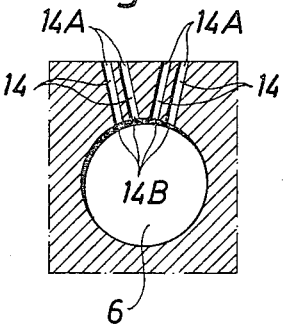
Figure 3C:
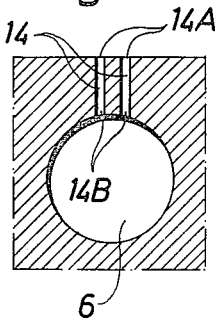

By forming a piston 7 with a relatively small length, as is apparant from FIG. 3′, it is possible to divide the flow departing through the outlet port 4 by means of the piston 7, the flow coming into the duct 6 above the piston 7, in FIG. 3′, being connected to the machine inlet as indicated by the letter I in FIG. 3′. The flow which can depart upwardly in the duct 6, in FIG. 3′, is thus connected to the suction side 8 of the machine, as indicated in FIG. 2.

FIGS. **3*a*–3*c* show how the holes 14 can be bored so that the orifices 14*a* thereof are placed in the Y-shaped configuration illustrated in FIG. 3, simultaneously as the opposite ends 14*b* of the holes can be connected to a duct 6, having substantially smaller width than the outlet port 4**.

There is however nothing to prevent forming the duct 6 rectangular, for example, is space permits, and with a width corresponding to the width of the outlet port 4, as shown in FIG. 3, the piston 7 associated with the duct being adapted to the cross-sectional shape of the duct.

Figure 7:
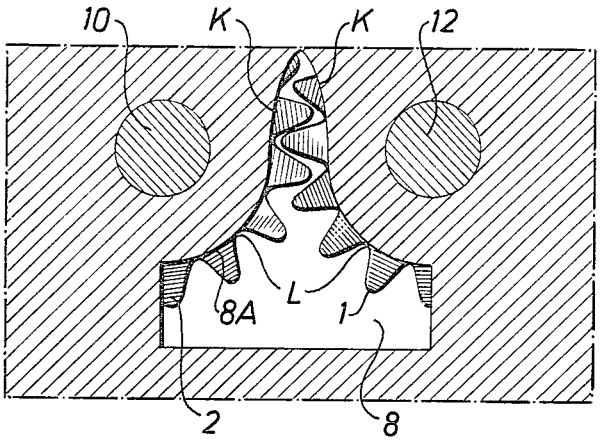
FIG. 7 is a view along the line VII—VII in FIG 1.

The flow (if the piston is placed between the upper and lower boundaries of the area 4), which is deflected downwardly in FIG. 3′ by the piston, constitutes the pumping flow of the machine, and it will be appreciated that by selecting the position of the piston 7 in the duct 6 it is possible to allow the machine to deliver a variable flow, although the driving shaft 10 is driven at a constant rate of revolutions. FIG. 7 illustrates how the suction side of the machine is formed. The suction duct 8 is connected to an opening **8*a***, allowing sucking in fluid at the end surface of the gears, from and including the instant when the teeth pass the axis plane P.

Figure 8:
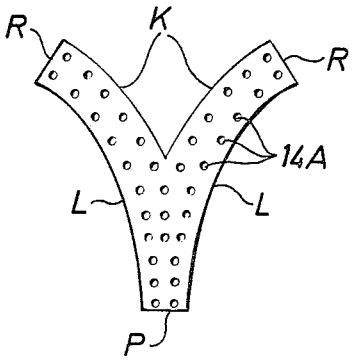
FIGS. 8 and 8′ are views of the port area arranged in an embodiment intended for utilization as a compressor.
Figure 8:
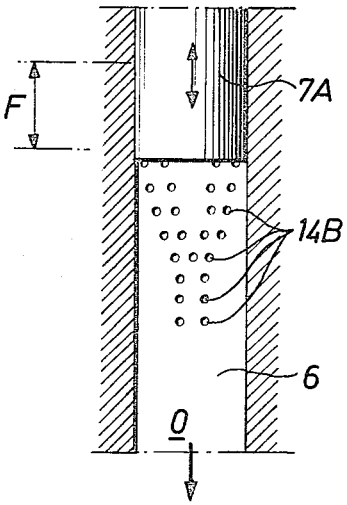

FIGS. 8 and 8′ illustrate an embodiment of the inventive machine, in which the piston **7*a* is made as an elongate plunger covering all the holes 14 from the upper boundary of the whole area, as is apparent from FIG. 8′, and down to the position assumed by the end surface of the piston 7*a*. The distance F between the end surface of the piston 7*a* and the upper boundary of the outlet opening 4 in FIG. 8′** defines the supercharging of the machine.

Figure 4:
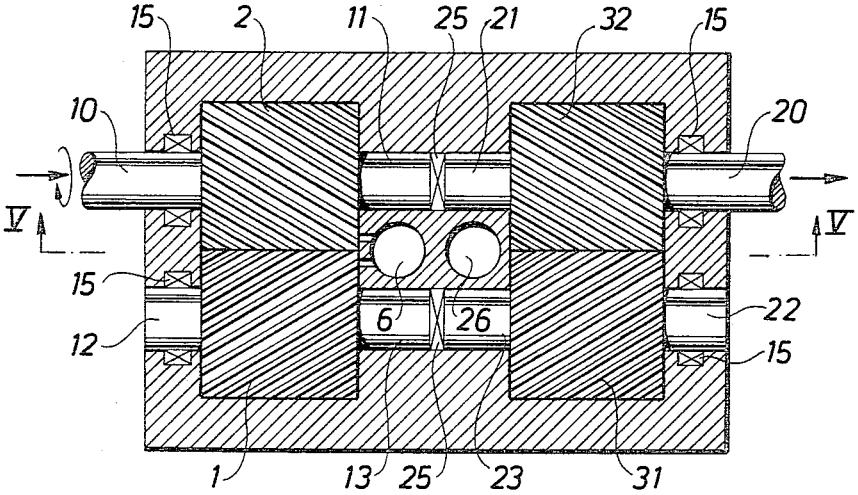
FIG. 4 is a schematic section through a second embodiment of the invention.
Figure 5:
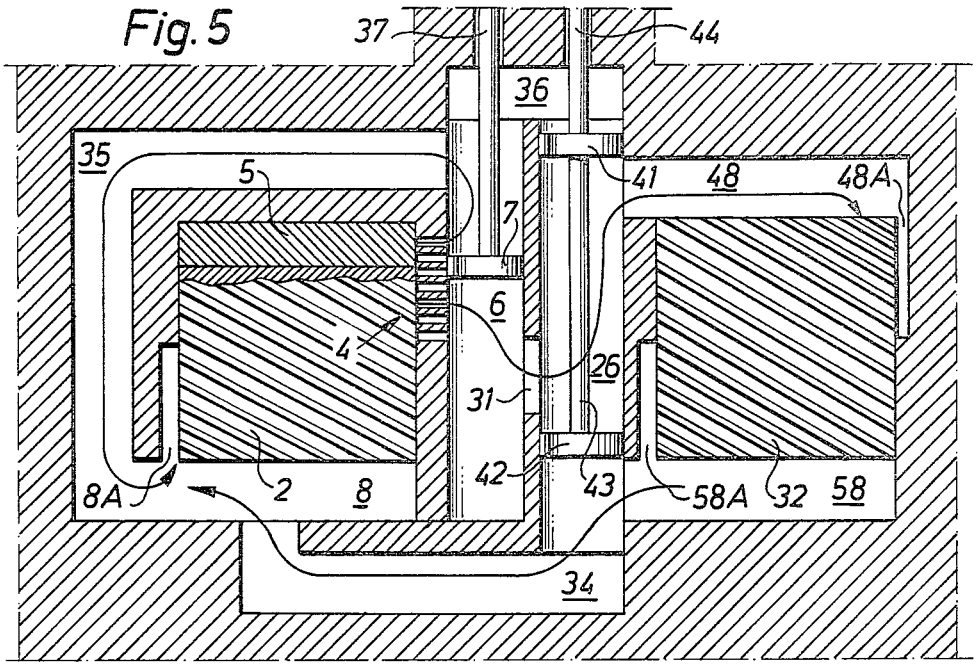
FIG. 5 is a section along the line V—V in FIG. 4.
Figure 6:
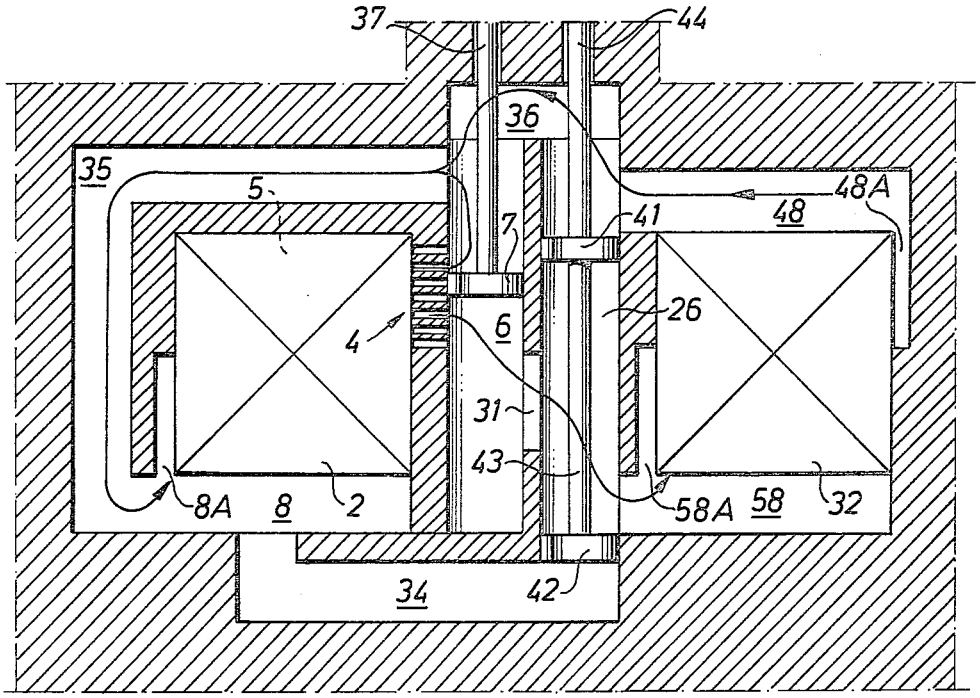
FIG. 6 is a section corresponding to FIG. 5, in which the reversing valve has been reset for reversing the drive shaft.

FIG. 4 is a horizontal section through a gearbox which, to the left in FIG. 4, comprises a hydraulic pump corresponding to the machine in accordance with FIG. 1, built together with a hydraulic motor illustrated to the right in FIG. 4, the hydraulic pump and hydraulic motor being liquid-coupled to form a gearbox having an infinite speed variation between the shafts 10 and 20, and also allows reversing the direction of rotation of the shaft 20 in relation to the shaft 10. FIGS. 5 and 6 are sections taken along the line V—V in FIG. 4 and illustrate how the gearbox is arranged for rotation of the shaft 20 in one or other direction of rotation.

The hydraulic motor is suitably formed with two helical gears 31, 32 journalled in the housing H by means of the shaft ends 20–23 of which the shaft 20 constitutes the output shaft of the gearbox. The shaft ends 20, 22, 10 and 12 are suitably journalled in roller bearings 15, while the shaft ends 11, 21 and 13, 23, respectively, mutually centered in pairs, bear against each other via thrust bearings 25. The hydraulic motor formed by the gears 31 and 32 (see FIG. 5) upwardly has a liquid duct 48 forming the fluid inlet of the hydraulic machine. A space **48*a* communicates with the duct 48. The space or duct 48*a* can be made in the way apparent from FIG. 7. The hydraulic motor outlet is defined by a duct 58 communicating with a gap 58*a*, whereby the arrangement 58, 58*a* can be made in accordance with the embodiment illustrated in FIG. 7. A reversing valve 41–44 is arranged in a duct 26, which can extend parallel to the control duct 6 in the space between the hydraulic pump and the hydraulic motor. The ducts 6 and 26 communicate via an opening 31. Pressurized fluid from the hydraulic pump 1, 2 flows out through the port 4 via the duct 6, the opening 31, the duct 26 and to the duct 48, from where the pressurized hydraulic fluid flows through the hydraulic motor 31, 32 to drive it. The outlet flow from the hydraulic motor departs from the duct 58 and flows via the duct 26 under the lower piston 42 of the valve through a duct 34 to the suction side 8 of the hydraulic pump. The unpressurized partial flow departing via the port 4, and deflected by the piston 7, flows through a duct 35 via a duct 6 to the suction side 8** of the hydraulic pump.

The flow path of the pressurized hydraulic flow is illustrated by the heavy arrow and the pressureless flow by the fine arrow. FIG. 6 illustrates the machine of FIG. 5 when the valve 41–44 is reversed to such a position that the flow assumes the flow pattern indicated by the heavy and fine arrows, respectively, which means that the hydraulic motor 31, 32 rotates in the opposite direction compared with that of FIG. 5.

The valve 41–44 can comprise two pistons 41, 42 mounted on a piston rod 43, 44, the pistons 41, 42 sealing against the walls of the duct 26. The distance between the pistons 41, 42 is adapted to the distance between the connection of the ducts 48, 58 to the duct 26 so that a displacement of the valve arrangement 41–44 in a vertical direction results in reversing of the flow through the hydraulic motor.

The principles, preferred embodiments and mode of operation of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the present invention. Accordingly, it is expressly intended that all such variations and changes which fall within the spirit and scope of the present invention as defined in the claims be embraced thereby.

What is claimed is:

1. A gear machine comprising two helical gears having a plurality of teeth and running in mesh with each other, a first sealing body arranged against one end surface of the gear pair, and fluid port in the first sealing body, a second sealing body arranged against outside circles of the gears at one meshing zone, tooth profiles of the two gears are alike with each tooth profile including a flank which continuously merges into a rounded top and a rounded bottom, the tops of the teeth of one of the gears being adapted for sealing against the bottoms of the teeth of the other gear in a plane through the axes of the gears, the port includes a plurality of holes at one end opening out at said end surface of the gear pair in a zone comprising an area substantially including the union of the surfaces which are each defined by the outside circle and a circle defined by the bottoms of the respective gear teeth between the axes plane and a gear radius (R) forming an angle ($\alpha$) with the axes plane, said angle ($\alpha$) does not exceed a value of $B \times (1/R) \times \text{tangent } \beta$, where B is the width of the gear pair, R is the outside circle radius of the respective gear and $\beta$ is the helix angle of the gears, the plurality of holes at their other ends opening out in a duct at axially separated places in the duct in the same order as the holes open out at said one end to said end surface in the direction of rotation of the gears, a sealing piston displaceably arranged in the duct, one end of the duct communicates with a fluid outlet of the machine, and means for displacing the piston in the duct to enable the machine to be regulated at a constant rate of revolutions.

2. The machine as claimed in claim 1, wherein the piston is arranged for closing the holes in a direction in towards the axes plane along a longitudinal axis of the duct, the machine thus being adapted for use as a compressor, and the displacement of the piston determining the supercharging of the machine.

3. The machine as claimed in claim 1, wherein the other end of the duct communicates with a fluid inlet of the machine, the piston having a small axial extent whereby the machine is adapted for use as a hydraulic pump and the position of the piston in the duct regulates the machine capacity.

4. The machine as claimed in claim 3, wherein said one end of the duct is connected to a hydraulic motor, displacement of the piston varying the rate of revolutions of the hydraulic motor which rate of revolutions is independent of that of the gears.

5. The machine as claimed in claim 4, further comprising a second duct arranged for refluxing the flow departing from the hydraulic motor to the inlet of the two gears.

6. The machine as claimed in claim 5, wherein the hydraulic motor is reversible, and further comprising valve means for selectively connecting said one end of the duct to either inlet of the reversible hydraulic motor.

7. The machine as claimed in claim 6, wherein the valve means is arranged for simultaneously connecting a respective outlet in use of the hydraulic motor to the suction side of the gear pair.

* * * * *